US009500415B2

(12) United States Patent
Bolek et al.

(10) Patent No.: US 9,500,415 B2
(45) Date of Patent: Nov. 22, 2016

(54) HEAT EXCHANGER WITH LAMINARIZER

(75) Inventors: Lukas Bolek, Plzen (CZ); Jiri Dejmek, Plzen (CZ); Jiri Ruzicka, Plzen (CZ); (Continued)

(73) Assignee: UNIVERZITA KARLOVA V PRAZE LEKARSKA FAKULTA V PLZNI, Plzen (CZ)

( * ) Notice: Subject to any disclaimer, the term of this patent is extended or adjusted under 35 U.S.C. 154(b) by 83 days.

(21) Appl. No.: 14/007,920

(22) PCT Filed: Jul. 20, 2012

(86) PCT No.: PCT/CZ2012/000067
§ 371 (c)(1),
(2), (4) Date: Sep. 26, 2013

(87) PCT Pub. No.: WO2013/013647
PCT Pub. Date: Jan. 31, 2013

(65) Prior Publication Data

US 2014/0020868 A1 Jan. 23, 2014

(30) Foreign Application Priority Data

Jul. 22, 2011 (CZ) ..... PV 2011-449

(51) Int. Cl.
*F28F 1/10* (2006.01)
*F28F 1/00* (2006.01)
(Continued)

(52) U.S. Cl.
CPC . *F28F 1/00* (2013.01); *F28D 7/16* (2013.01); *F28F 9/22* (2013.01); *F28F 13/06* (2013.01);
(Continued)

(58) Field of Classification Search
CPC ..... F28D 2021/005; F28D 7/16; F28D 7/1607; F28F 9/0219; F28F 9/0224;
(Continued)

(56) References Cited

U.S. PATENT DOCUMENTS 87,479 A * 3/1869 Towne ..... 75/514
827,479 A 7/1906 Town
(Continued)

FOREIGN PATENT DOCUMENTS

CZ 269522 B6 12/1989
CZ 300 266 B6 4/2009
(Continued)

OTHER PUBLICATIONS

Krouzecky, A., et al., "Regional cooling of the extracorporeal blood circuit: a novel anticoagulation approach for renal replacement therapy?", Intensive Care Med., 35, pp. 364-370, (2009).

*Primary Examiner* — Len Tran
*Assistant Examiner* — Claire Rojohn, III
(74) *Attorney, Agent, or Firm* — Nath, Goldberg & Meyer; Jerald L. Meyer

(57) ABSTRACT

A heat exchanger enables an efficient and uniform cooling and/or heating of liquids, in particular of blood. The heat exchanger includes an elongated, substantially cylindrical, housing, a plurality of capillaries, which are fastened inside the housing by means of partitions so that they are substantially parallel with the longitudinal axis of the housing and mutually placed in defined distances from, while the housing contains an inlet and an outlet of the cooling/heating liquid and a finishing element at each end. The element contains an input, or output of the cooled/heated liquid and includes inside the housing at least one laminarizer in the form of a partition with a plurality of openings, always one opening for each capillary, the diameter of the opening being bigger than the outer diameter of the capillary, and laminarizer is placed so that capillaries go through the center of the opening in the laminarizer.

4 Claims, 7 Drawing Sheets

(75) Inventors: Jiri Benes, Plzen (CZ); Zuzana Petrankova, Veltruby (CZ)

(51) Int. Cl.

| | |
|---|---|
| ***F28D 7/16*** | (2006.01) |
| ***F28F 9/22*** | (2006.01) |
| ***F28F 13/06*** | (2006.01) |
| *F28D 21/00* | (2006.01) |
| *F28F 21/06* | (2006.01) |

(52) U.S. Cl.
CPC ..... *F28D 2021/005* (2013.01); *F28F 21/062* (2013.01)

(58) Field of Classification Search
CPC ..... F28F 9/22; F28F 2009/222; F28F 2009/226; F28F 13/00; F28F 21/062
USPC ..... 210/321.8, 321.81, 450; 165/172
See application file for complete search history.

(56) References Cited

U.S. PATENT DOCUMENTS 3,769,162 A * 10/1973 Brumfield ..... 435/2
3,848,660 A * 11/1974 Reilly et al. ..... 165/46
3,934,982 A * 1/1976 Arp ..... A61M 1/1698 128/DIG. 3
3,963,071 A * 6/1976 Levin ..... F23D 11/44 165/104.19
4,162,702 A * 7/1979 Andersson ..... F28D 7/08 165/142
4,177,816 A * 12/1979 Torgeson ..... 607/106
4,204,573 A * 5/1980 Clark ..... F28D 7/106 165/142
4,342,723 A * 8/1982 Sado et al. ..... 422/48
4,639,353 A * 1/1987 Takemura et al. ..... 422/46
4,657,743 A * 4/1987 Kanno ..... A61M 1/1698 210/321.64
5,084,244 A * 1/1992 Muramoto ..... A61M 1/1698 128/DIG. 3
5,160,615 A * 11/1992 Takagi ..... B01D 61/30 210/321.8
5,192,499 A * 3/1993 Sakai ..... A61M 1/1698 128/DIG. 3
5,294,397 A 3/1994 Oshiyama et al.
6,206,086 B1 * 3/2001 McKey ..... F28D 7/1646 165/158
6,458,109 B1 * 10/2002 Henley et al. ..... 604/304
2010/0114003 A1 5/2010 Ruzicka et al.
2010/0282451 A1 * 11/2010 Singh ..... F01K 7/06 165/162

FOREIGN PATENT DOCUMENTS

| | | | |
|---|---|---|---|
| DE | 10 2008 062 424 | A1 | 7/2009 |
| EP | 0 524 662 | B1 | 1/1993 |
| JP | 56-59197 | A | 5/1981 |
| JP | 2-102661 | A | 4/1990 |
| JP | 2554016 | B2 | 11/1996 |
| WO | 2008/062344 | A2 | 5/2008 |

* cited by examiner

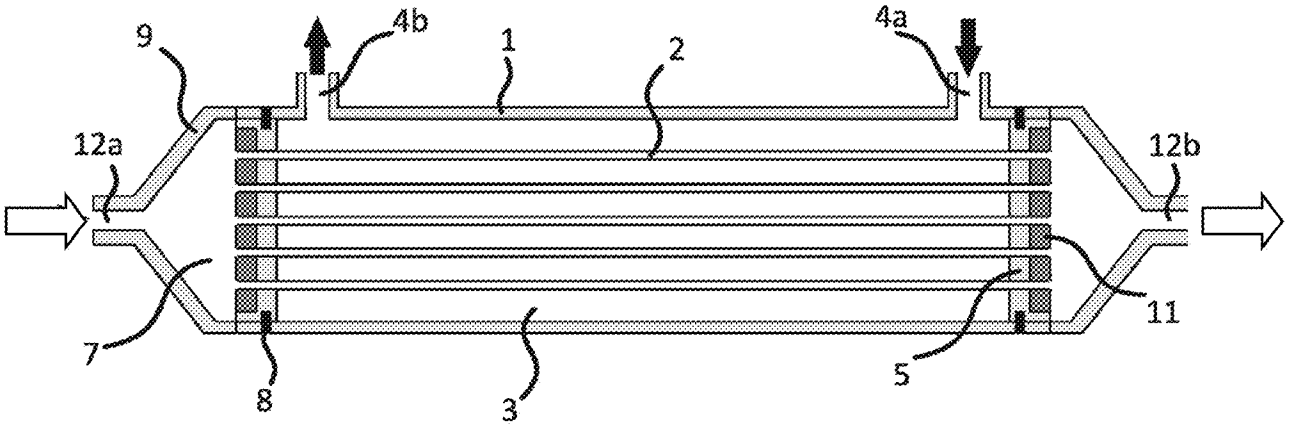
Fig. 1.1

Fig. 1.2
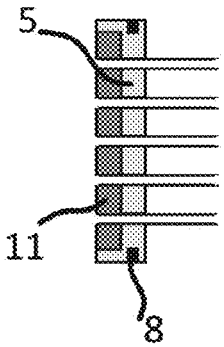
Fig. 2.2
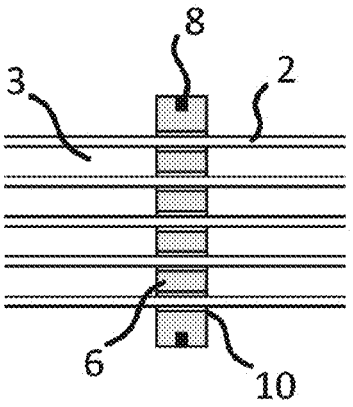
Fig. 3.2
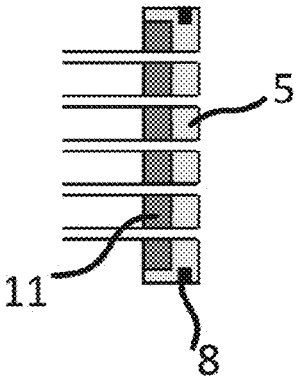

Fig. 2.1
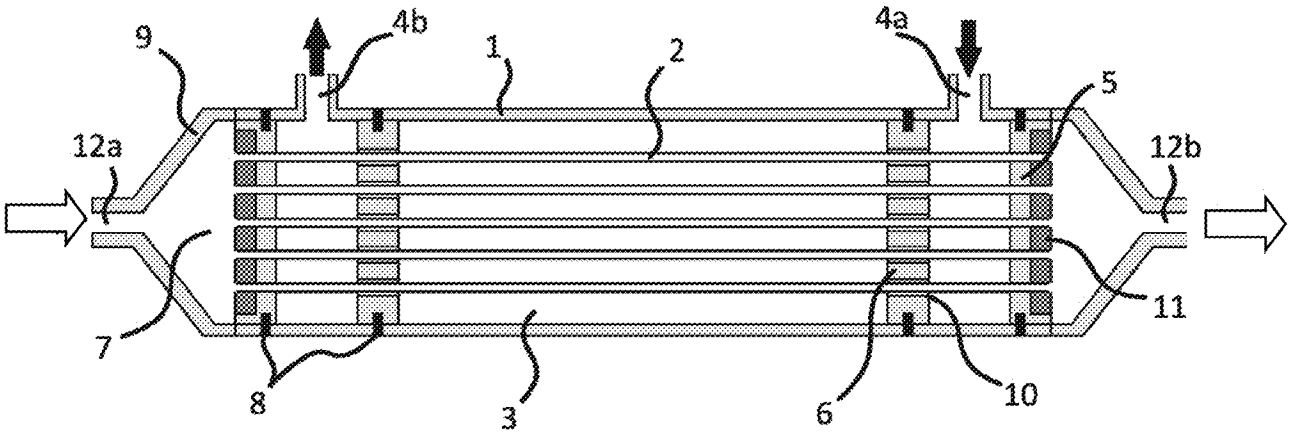

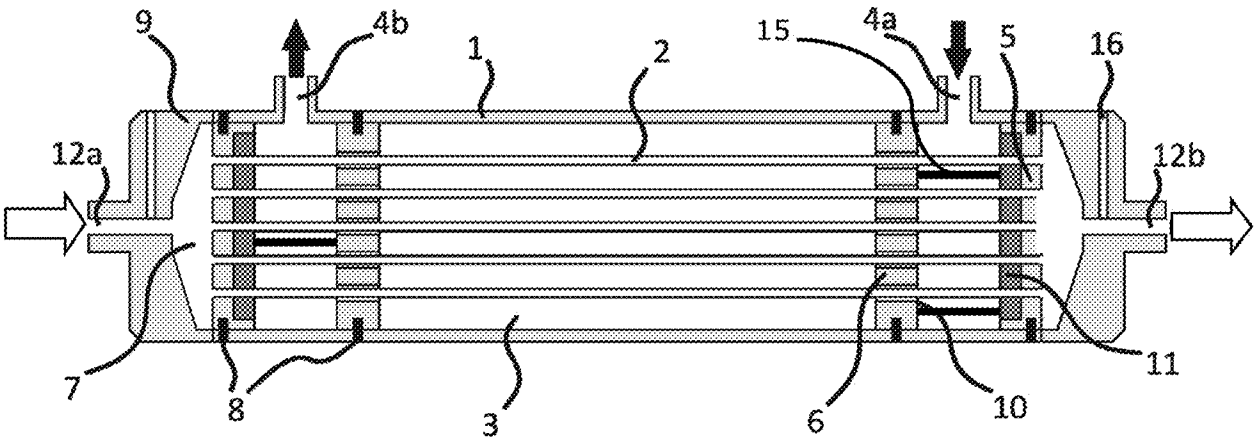
Fig. 3.1

Fig. 4.1
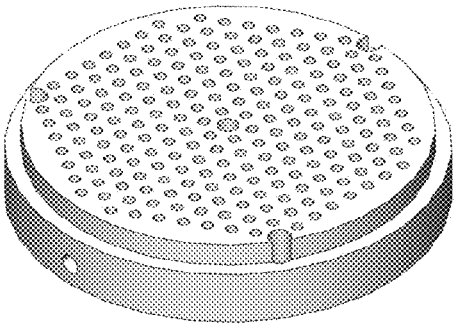
Fig. 4.2
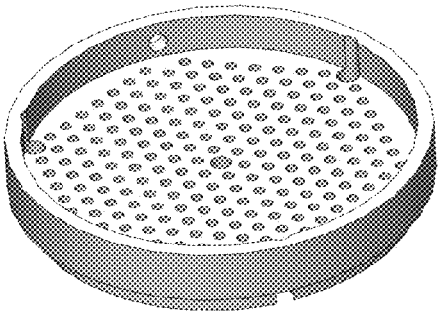
Fig. 5.
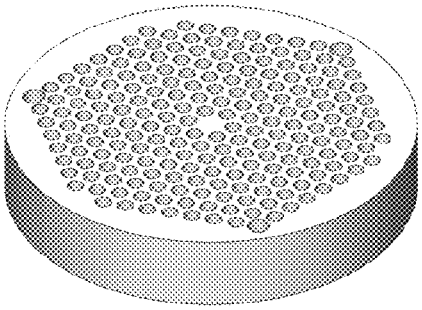

Fig. 6.1
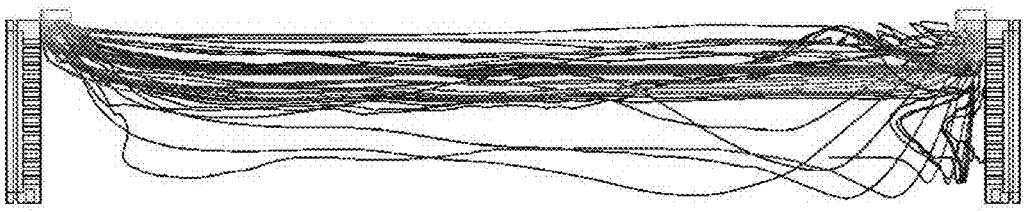
Fig. 6.2.
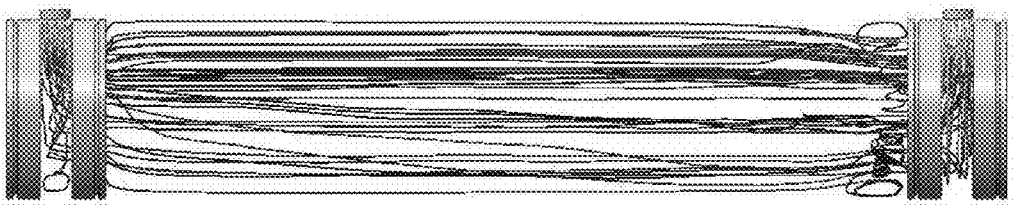
Fig. 6.3
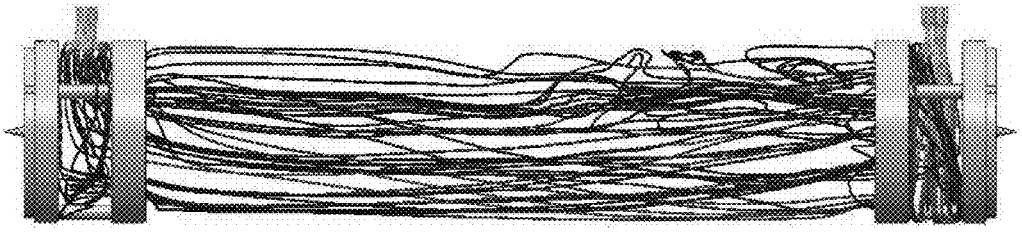

Fig. 6.4a
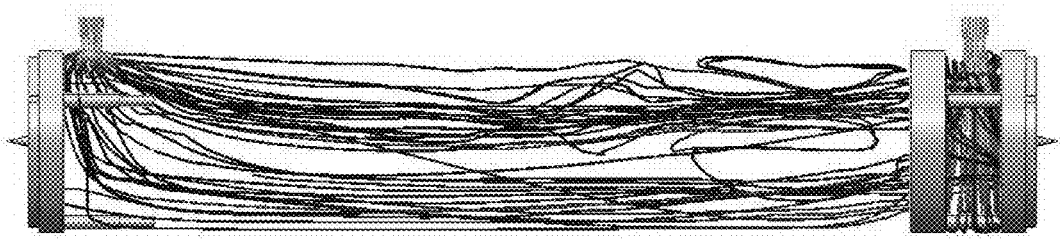
Fig. 6.4b
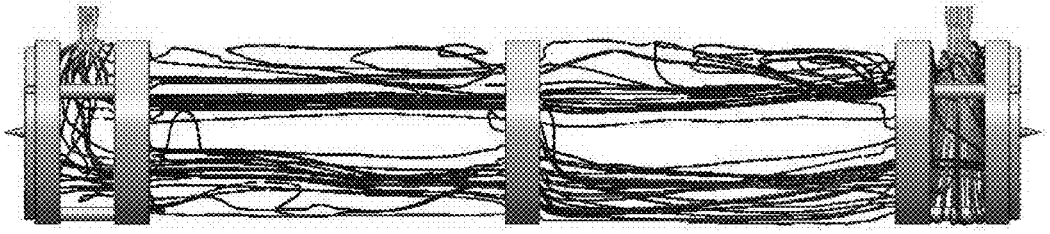
Fig. 6.4c
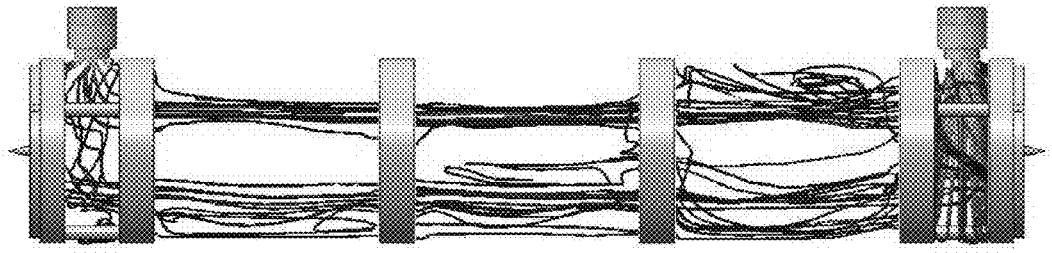

HEAT EXCHANGER WITH LAMINARIZER

This is a National Phase Application filed under 35 U.S.C. 371 as a national stage of PCT/CZ2012/000067, filed Jul. 20, 2012, and claims priority benefit from Czechoslovakian Application No. PV 2011-449, filed 22 Jul. 2011 the content of each of which is hereby incorporated by reference in its entirety.

FIELD OF THE INVENTION

The invention relates to a heat exchanger enabling efficient and uniform cooling and/or heating of liquids, particularly blood. This exchanger is intended particularly for use in medicine.

BACKGROUND OF THE INVENTION

It is known that extracorporeal contact of blood with synthetic materials activates the coagulation mechanism and coagulation occurs. Current research shows that cooling the blood in an external circulation lowers to a significant extent its undesirable coagulation, which means a big potential for medicine. Patients with kidney diseases are a numerous group which could benefit significantly from this discovery. This new principle of preventing the natural blood coagulation (Kroužecký, A. et al., Intensive Care Med (2009) 35:364-370, CZ300266, DE102008062424, U.S. 2010114003) could replace the current practice which uses other "anticoagulation" mechanisms (e.g. heparin), often with numerous undesirable effects. The basic prerequisite for the efficiency of this new principle is providing sufficient cooling and then heating (prior to entering the body circulation) of blood by means of a special heat exchanger. Both heat exchangers suitable for technical purposes and heat exchanger intended for medical use, namely for cooling/heating of blood, are known from the state of the art.

An exchanger serving as a heater or cooler of water, steam, oil etc., containing a bundle of tubes, was described in the patent CZI33689. Another tube heat exchanger, suitable for technical purposes, is disclosed for example in the patent CZ269522.

A heat exchanger suitable for blood is disclosed in U.S. Pat. No. 4,177,816, where the tubes for leading blood are of metal and contain inserts (for example in the shape of a strip) for ensuring the laminar flow of blood.

A tube heat exchanger made of plastics, suitable for medical use, i.e. for cooling/heating of blood, is disclosed in JP56059197. The exchanger disclosed in JP2102661 tries to achieve a higher efficiency of heat exchange by leading the cooling liquid through metallic tubes inside the body of the exchanger and blood flows through the body of the exchanger.

Another example of a heat exchanger for medical use is the exchanger disclosed in U.S. Pat. No. 5,294,397.

All the cited documents mention as a serious problem the homogeneity and efficiency of cooling/heating. None of the disclosed exchangers where blood flows in tubes places inside the housing containing the cooling/heating liquid contains any device or any construction element providing uniform laminar flow of the cooling/heating liquid, thus ensuring a high homogeneity and efficiency of blood cooling/heating. The efficiency of such a type of the exchanger is dependent, among others, on the quality of flowing of the cooling/heating liquid, which none of the prior art documents addressed. The flowing of the cooled/heated liquid, i.e. blood, does not pose any problem, since blood flows through thin tubes (capillaries) and basically it is always a laminar flow. On the other hand, the flowing of the cooling/heating liquid in the vessel of the exchanger (relatively high volume) by its character (turbulent, laminar) significantly influences the efficiency of the exchanger which is an important aspect not only in medical use.

In the medical practice, there is always a need of an efficient and relatively cheap (suitable for one use) device for blood cooling/heating. The inventors therefore designed a new heat exchanger containing a new element—laminarizer—which regulates the flow of the cooling/heating liquid so that the flow is uniform, which eliminates blind spots in the body of the exchanger and increases the cooling/heating effect of the heat exchanger.

SUMMARY OF THE INVENTION

The invention relates to a heat exchanger intended namely for cooling or heating (for simplification referred to throughout the text as cooling/heating) of blood in external blood circulation, which is also convenient for cooling/heating of other liquids. The heat exchanger according to the invention comprises an outer housing, in which a plurality of capillaries (tubes or pipes of a small diameter; the terms capillary, capillary tube, tube or pipe are used herein interchangeably). Capillaries are fixed inside the housing by means of partitions and they go through at least one, preferably two (optionally more) laminarizers. The housing serves to maintain the cooling/heating liquids in contact with capillaries, as well as a supporting construction of the device, and also as a heat isolation of the cooling/heating liquid. In the perimeter of the housing are placed a feeding opening (inlet) and draining opening (outlet) of the cooling/heating liquid, and further the fixing elements for locking the inner parts, i.e. partitions and one or more laminarizers. The outer ends of the housing are on both sides provided with a finishing element the aim of which is to take in and take out the cooled/heated liquid by means of the intake opening (input) and exit opening (output).

The partitions serve to fix the capillaries and are placed near the ends of the housing and they are fastened by means of fixing elements. Such a fixing maintains all capillaries (namely if flexible tubes are used) in a tightened and parallel position with a precisely defined distance and distribution of individual capillaries over the whole length of their laying.

In the inside part of the heat exchanger, at least one laminarizer, preferably two laminarizers, are placed so that they lay in the space between the partitions fixing capillaries, in a suitably selected distance from the partitions to fix the capillary tubes, so that the space between the laminarizer and the partition were small, yet so that it enabled the inlet and outlet of the cooling/heating liquid. Further one or more laminarizers may be placed inside the housing, at regular or irregular distances. There is a plurality of openings in the laminarizer, the number of openings being identical to the number of capillaries, the opening having suitably selected diameter and layout, i.e. having a diameter bigger than the outer diameter of the capillary, while capillaries go through the centre of these openings. The laminarizer is tightly fixed to the housing by fixing elements, axially symmetrical to the partitions and capillaries, just as the partition, so it does not move and the axial symmetry of individual capillaries and the openings in the laminarizer is maintained. The laminarizer regulates the flow of the cooling/heating liquid so that a regular, substantially laminar flow occurs, eliminating the blind spots and increasing the cooling/heating effects of the heat exchanger.

The exchanger according to the invention is constructed so that it meets the requirements for medical use, both from the material and functional points of view.

The exchanger, i.e. all components thereof, is made of plastics, either by one type, or by a combination of more types (e.g. PVC, PMMA, PTFE, PE, PUR, etc.), which on one hand are poor heat conducting materials, but on the other hand are routinely used thanks to their short-term, and in some cases even long-term, medical harmlessness namely in medicine, food industry, etc. Some of these materials are moreover easily processable and their price is low, which is important mainly from the commercial point of view, namely in case of exchangers for medical use, where single-use (i.e. disposable exchanger) is expected. At the same time, the poor heat conductivity is to a certain extent advantageous, since only a low transmission of heat between the exchanger and surroundings thereof occurs. The connection of materials and individual parts is solved by pouring by the same or different type of plastics, by gluing, heat-sealing or compressing. The technologies of processing of plastics and plastic products suitable for manufacturing the heat exchanger according to the invention are commonly known to a person skilled in the art.

The cooling/heating liquid is any non-aggressive liquid; distilled water is convenient, possibly with additives lowering the solidification point, which are not aggressive towards the materials used in the exchanger. For cooling of blood, the suitable coolant is physiological saline. The overall volume of the cooled/heated liquid in the exchanger is minimised to volumes of tens of mililiters, which is advantageous in applications requiring minimum losses in volumes—e.g. extracorporeal blood circulation. This volume is the least in the preferred embodiment of heat exchanger in example 3 where, apart from other part improvements, the reduction of the residual volumes of the cooled/heated liquid occurred, compared to the embodiment from example 2.

Due to the fact that the exchanger is intended primarily for medical use, it is constructed in order to reduce the risks arising with the blood circulation. Among the basic risks in the case is the risk of blood coagulation which might occur if it flowed slowly. It is therefore essential to ensure a sufficient speed of blood flow through the capillaries of the exchanger. However, at higher speeds, the time when blood is in contact with the inner walls of capillaries is reduced—to compensate for this phenomenon, it was necessary to maximise the area the blood is in contact with. The following were also taken into account: the volume of flowing blood (which should be as small as possible), cross-section of capillaries, their length, hydrodynamic resistance (which is important in connection with further devices, such as dialysis monitor), the volume of cooling/heating liquid flowing around the capillaries and the overall volume of the exchanger. The exchanger according to the invention in the embodiments mentioned in examples represents a compromise between all the above mentioned requirements. A skilled person will understand that the particular dimensions and shapes of parts of the exchanger may be adjusted, without such an exchanger deviating from the concept of the heat exchanger according to the invention as described herein and as defined in the patent claims.

In a preferred embodiment, the selected parameters of the exchanger (see example 2) ensure a very low hydrodynamic resistance (the exchanger increases the pressure of flowing blood only by units of kPa) and a risk-free speed of flowing blood (units of ml/s) while increasing the maximum possible temperature increase or reduction. Once a skilled person gets acquainted with the exchanger with laminarizer concept disclosed in the present application, determining other suitable dimensions of the exchanger depends among others on the purpose of the exchanger, and is a substantially routine issue, which a skilled person will solve by routine experimenting, optionally in combination with mathematical modeling.

The primary field of use of this device is medicine, but it may find its use also in pharmaceutical industry, cosmetics and food industry, etc. Apart from fields where there are strict requirements for maintaining the maximum hygiene and sterility, the device can be used repeatedly. In case of human blood, only single-use is envisaged. The expected production cost of the exchanger is relatively low compared to exchangers from other materials than plastics (namely PVC), which is advantageous for single-use, namely in expected higher volumes of production.

In particular, it is a subject of the present invention a heat exchanger comprising elongated, substantially cylindrical, housing, a plurality of capillaries which are fastened inside the housing by means of partitions, so that they are substantially parallel with the longitudinal axis of the housing and are mutually placed in defined distances from each other, while the housing contains an inlet and an outlet of the cooling/heating liquid, and at each end a finishing element containing the input or output of the cooled/heated liquid, characterised by the fact that it contains at least one laminarizer in the form of a partition inside the housing, with a plurality of openings, always one opening for each capillary, the diameter of the opening being bigger than the outer diameter of the capillary, and the laminarizer is placed so that capillaries go through the centre of the openings in the laminarizer.

Preferably, the heat exchanger according to the present invention contains two laminarizers.

In a preferred embodiment, the whole heat exchanger according to the invention is made of plastics.

In a preferred embodiment of the heat exchanger according to the invention the partitions are placed in the housing so that mounting side of the partition is oriented towards the space for cooling/heating liquid.

The heat exchanger according to the invention is preferably provided on the input and/or output of the cooled/heated liquid with a temperature sensor.

The features and advantages of the heat exchanger according to the invention will be further apparent from the examples of embodiments, with reference to the enclosed figures.

BRIEF DESCRIPTION OF THE DRAWINGS

FIG. 1.1—The heat exchanger substantially corresponding to the state of the art—overall view (longitudinal section). White arrows mark the direction of flow of the cooled/heated liquid, black arrows mark the direction of flow of the cooling/heating liquid.

FIG. 1.2—Detail of the partition and fixing of capillary tubes (section)

FIG. 2.1—The heat exchanger according to the invention containing two laminarizers—overall view (longitudinal section)

FIG. 2.2—Detail of the embodiment of the laminarizer (section) of the exchanger according to FIG. 2.1.

FIG. 3.1—The heat exchanger according to the invention containing two laminarizers—another preferred embodiment—overall view (longitudinal section)

FIG. 3.2—Detail of the partition and fixing of the capillary tubes in the heat exchanger according to FIG. 3.1.

FIG. 4.1—The fixing partition of the heat exchanger serving to attach the capillaries FIG. 4.2—The fixing partition according to FIG. 4.1.—view from the opposite side than the one shown on FIG. 4.1. showing the mounting space FIG. 5—The laminarizer of the heat exchanger according to the invention FIG. 6.1—Computer simulation of the cooling/heating liquid flow in a reference heat exchanger without a laminarizer according to FIG. 1.1.

FIG. 6.2—Computer simulation of the cooling/heating liquid flow in the heat exchanger according to the invention with two laminarizers according to FIG. 2.1.

FIG. 6.3—Computer simulation of the cooling/heating liquid flow in another preferred embodiment of the heat exchanger according to the invention with two laminarizers according to FIG. 3.1.

FIG. 6.4*a*—Computer simulation of the cooling/heating liquid flow in the heat exchanger according to the invention in the embodiment with one laminarizer FIG. 6.4*b*—Computer simulation of the cooling/heating liquid flow in the heat exchanger according to the invention in the embodiment with three laminarizers FIG. 6.4*c*—Computer simulation of the cooling/heating liquid flow in the heat exchanger according to the invention in the embodiment with four laminarizers

EXAMPLES OF EMBODIMENT OF THE INVENTION

Example 1

Reference Heat Exchanger without a Laminarizer

FIG. 1.1 represents a reference heat exchanger (which substantially corresponds to the heat exchanger according to the state of the art), i.e. a heat exchanger without a laminarizer.

The heat exchanger contains an elongated, substantially cylindrical, housing 1, a plurality of capillaries 2 (which are for example tubes or pipes), which are fastened inside the housing 1 by means of partitions 5, so that they are substantially parallel with the longitudinal axis of the housing 1.

The housing 1 serves to keep the cooling/heating liquid in contact with capillaries 2, as well as a supporting construction of the device, and also as a heat isolation of the cooling/heating liquid. In the perimeter of the housing 1 are placed an inlet 4*a* and an outlet 4*b* of the cooling/heating liquid and further fixing elements 8 for locking the partitions 5. A finishing element 9 is mounted on each outer end of the housing 1, the aim of which is to take in or take out the cooled/heated liquid by means of the input 12*a* or the output 12*b*. The inlet 4*a* of the cooling/heating liquid is placed on the opposite end of the housing 1 than the inlet 12*a* of the cooled/heated liquid, since it is in principle a countercurrent heater exchanger (black arrows on FIGS. 1.1, 2.1 and 3.1 mark the flow direction of the cooling/heating liquid, white arrows mark the flow direction of the cooled/heated liquid).

The partitions 5 (FIG. 1.2, 4.1 a 4.2) serve to fix the capillaries 2 by pouring the space 11 by a suitable mounting material (e.g. acrylate resin, such as Spofakryl). The fixing partitions 5 are placed at both ends of the housing 1 are fastened by means of the fixing elements 8. Such a locking keeps all capillaries 2 in a direct, non-deformed shape in exactly defined distances from one another, axially symmetrical with the partition and parallel to each other.

The cooled/heated liquid is led through the input 12*a* to capillaries 2, which are oriented inside the housing 1 axially to the longitudinal axis of the housing. At the opposite end of the exchanger, the cooled/heated liquid is led to the output 12*b* and leaves the heat exchanger. The capillaries 2 are fastened in the partition 5 (detail on FIG. 1.2), which separates the space 3 for the cooling/heating liquid from the space 7 for the cooled/heated liquid. The partition 5 contains the same number of opening as is the number of capillaries 2 of a substantially identical diameter (or rather adequately bigger so that capillaries 2 could be passed through the openings) as the outer diameter of capillaries 2, capillaries 2 then being heat-sealed or glued (or fastened in any other suitable way, known to a skilled person) to the partition 5, the connections being perfectly tight in order to avoid the undesirable mixing of the cooling/heating and cooled/heated liquids.

Example 2

Basic Embodiment of the Heat Exchanger with Two Laminarizers

The heat exchanger according to the invention (see the two variant of embodiments on FIG. 2.1 a 3.1) is substantially similar to the embodiment according to example 1 (FIG. 1.1). The essential difference is that it contains two laminarizers 6 (for detailed representation see FIG. 2.2 and FIG. 5), which effectively divide the flow of the cooling/heating liquid to all capillaries 2, through which the cooled/heated liquid flows, and regulate the flow of the cooling/beating liquid so that uniform and more effective heat exchange occurs on the outer surface of capillaries, and consequently also efficient cooling/heating of the cooled/heated liquid. In this embodiment, two laminarizers 6 are placed on both sides of the housing 1 of the exchanger in a suitable distance (approximately 1-2 cm from partitions 5, i.e. approximately 3 cm from the ends of the housing 1, the overall length of capillaries 2 being approximately 30 cm) from the fastening of capillaries 2 in the partition 5. The laminarizers 6 are, similarly to partitions 5, locked by means of fixing elements 8 to the housing 1, so that they do not move.

In this particular embodiment, the outer diameter of the housing 1 is 70 mm and the inner diameter of the housing is 62 mm. The size of the inner diameter is depending, among others, on the number of capillaries 2 in the exchanger. In this embodiment, the exchanger contains capillaries having the length of 30 cm, having the inner diameter of 1 mm, outer diameter of 1.5 mm, the total number of capillaries being 200, the overall volume of the cooled liquid in capillaries of the exchanger, including "dead spaces" is 65 ml. This arrangement ensures a very low hydrodynamic resistance; the exchanger increased the pressure of the flowing water only by 7 kPa. This preferred embodiment was selected based on previous optimization experiments and results of mathematical modeling.

The aim of the laminarizer 6 is to ensure uniform flowing of the cooling/heating liquid inside the housing 1, which, as was proven experimentally, significantly increases the cooling/heating effect of the exchanger, compared to the dimensionally identical exchanger without the laminarizer 6 (see example 1, FIG. 1.1). The laminarizer 6 is constructed substantially as a partition with the openings 10 for each capillary 2. The laminarizer causes a uniform penetration of the cooling/heating liquid in openings 10 around capillaries 2, while the whole exchanger is constructed so that capillaries 2 pass through the centre of the openings 10 in the laminarizer 6. The size of the opening 10 is dependent, among others, on the diameter of the capillary, on the speed of flow of the cooling/heating liquid, on the inner diameter of the exchanger, and on the number and arrangement of capillaries. The diameter of the opening 10 is determined by physical laws known to a skilled person so that the cooling liquid creates laminar flow around individual capillaries (the Reynolds number for the given configuration is lower than 2000). The calculated value was then verified e.g. by means of a computer simulation and finally experimentally by verification of the efficiency of the exchanger in cooling/heating of the liquid (water, blood).

The inlet 4*a* and the outlet 4*b* of the cooling/heating liquid in the perimeter of the housing 1 do not have to be placed in a mutually identical position with respect to the perimeter of the housing 1 (as shown e.g. on FIG. 2.1), they can be in any position to each other, for example advantageously in an "opposite" position (shifted by 180° on the perimeter of the housing 1).

Example 3

Comparison of the Function of a Heat Exchanger without a Laminarizer and a Heat Exchanger with Two Laminarizers in Cooling/Heating of Water From the point of view of functionality, the exchanger according to the invention ensures cooling of the flowing liquid, e.g. blood, by 15 to 25° C., depending on the chosen flow rate, characteristic for the given construction (e.g. 300 to 700 ml/min), at a temperature of the cooling temperature from 5 to 10° C. With the decreasing flow rate of the cooled liquid and the decreasing temperature of the cooled liquid, a higher temperature difference may be achieved. For technical purposes, it is possible to achieve temperatures of cooled temperature lower than 0° C. if non-freezing cooling mixtures are used.

The exchanger is also intended for heating liquids. For example, when keeping the same above mentioned flow rate and the temperature of the heating liquid of approximately 35 to 45° C., the flowing liquid, in particular for example blood, may be heated by 15 to 25° C.

For example, in case of using the reference exchanger without a laminarizer (see example 1) the cooled liquid (distilled water) at a temperature of 37° C. cooled down to 20° C. at the flow rate of 440 ml/min, at the temperature of the cooling liquid (distilled water) of 7° C. and the flow rate of the cooling liquid of 2 l/min. At precisely the same conditions, the exchanger with two laminarizers according to the invention (FIG. 2.1) led to the decrease of temperature of the cooled liquid from 37° C. to 15° C., which is a significant difference.

In case of the use of the reference exchanger (see example 1) for heating, the heated liquid (distilled water) having the initial temperature of 20° C. was heated to 31° C. at the flow rate of 440 ml/min, temperature of the heating liquid of 44° C. and flow rate of the healing liquid of 2 l/min. When using the exchanger with two laminarizers according to the invention (FIG. 2.1) for heating, at precisely the same conditions, the heated liquid (distilled water) was heated from 20° C. to 37° C.

The cited numeric values are only selected representative values. Experiments were carried out repeatedly and similar values were obtained. The higher cooling and heating efficiency of the exchanger according to the invention (FIG. 2.1) compared to the reference exchanger (FIG. 1.1), defined as the achieved difference of temperatures of the cooled/heated liquid at the input and output at otherwise identical temperatures and flow rates were statistically significant.

Example 4

Verification of the Functionality of the Heat Exchanger with Blood

Similar experiments as in example 3 were carried out with animal (pig) blood as the cooled/heated liquid. Very similar results were achieved.

For example, in case of the use of the exchanger with two laminarizers (see FIG. 2.1 or 3.1) the unmodified blood at the temperature of 36.6° C. was cooled down to 14.3° C. at the flow rate of 400 ml/min, at the temperature of the cooling liquid (distilled water) of 6.5° C. and the flow rate of the cooling liquid of 2 l/min.

In the experiment with the unmodified animal blood, the risk of blood coagulation in the tubes of the exchanger was also being verified when decreasing the blood flow rate in combination with insufficient cooling. The experiment showed that not even extreme conditions, i.e. decreasing the blood flow rate to 200 ml/min and the temperature of the surroundings of tubes approximately 27° C. (tube material—PVC) does not lead yet to blood coagulation in the tubes of the exchanger. It is an extreme combination of negative effects, which could already lead to activation of blood coagulation processes in its return to the blood circulation which would be unacceptable in the considered treatment process (e.g. dialysis).

Example 5

Improved Embodiment of the Heat Exchanger with Two Laminarizers

Another preferred embodiment of the heat exchanger (see FIG. 3.1) is characterised by reduced residual volumes (namely the volume of the space 7 between the basic body of the housing 1 and the finishing element 9) and a simpler construction from the manufacturing point of view and is further provided by temperature sensors 16 at the input 12*a* and the output 12*b* of the exchanger.

In this preferred embodiment of the heat exchanger, the construction was improved, firstly in the change of shape of the finishing element 9 (see FIG. 3.1), which led to the reduction of the space 7, and thus to the reduction of the residual volume of the cooled/heated liquid. Furthermore, the inner arrangement of the fixing partition 5 and the laminarizer 6 was improved. Moreover, the finishing element 9 contains an integrated temperature sensor 16, for direct measuring of temperature incoming and/or outgoing cooled/heated liquid at the input 12*a* and the output 12*b*. By the suitable placing of the sensor 16 (FIG. 3.6) and by its minuscule size, its impact on the flow of the cooled/heated liquid is minimised. The fixing partition 5 and the laminarizer 6 are in this embodiment tightly connected by three regularly placed distance pillars 15 (and thus form a complex called head). The fixing partition 5 has, contrary to the previous embodiment (example 2), oppositely localized space for fixing capillaries 2 by pouring the space 11 over by a suitable mounting material. This space 11 is placed here from the inner side (i.e. from the side intervening into the space 3 of the cooling/heating liquid) of the fixing partition 5, as is apparent from FIGS. 3.1. and 3.2), in other words capillaries are poured by a sealing substance from the side of the cooling/heating liquid (i.e. in the space 3 and not in the space 7, compare FIGS. 2.1. and 3.1). This prevents the contact of the mounting material with blood.

Example 6

Computer Simulation of the Functionality of the Heat Exchanger with Different Numbers of Laminarizers FIG. 6.1 displays a computer simulation of the flow of the cooling/heating liquid in the reference heat exchanger without laminarizers 6 (example 1, FIG. 1.1). It is apparent from this model that the cooling/heating liquid does not flow uniformly; especially "blind" areas with minimum alteration of the cooling/heating liquid are formed. On the other hand, as is apparent from FIG. 6.2 (exchanger according to FIGS. 2.1) and 6.3 (exchanger according to FIG. 3.1), two laminarizers 6 in the exchanger according to the invention markedly regulate the flow of the cooling/heating liquid, and thus create a uniform flow, which eliminates blind spots and significantly improves the cooling/heating effect of the heat exchanger.

When using the exchanger with one laminarizer 6 placed nearer the inlet 4*a* of the cooling/heating liquid (see FIG. 6.4*a*), better cooling/heating effect was achieved than in case of the exchanger without a laminarizer (see FIG. 6.1), however the improvement was not so significant as in the exchanger with two laminarizers 6 (see FIG. 3.1) placed in the vicinity of partitions 5 (see FIG. 6.3). Computer simulations further showed that for example inserting one or two (optionally more) further laminarizers 6 between two "utmost" laminarizers 6 (see FIGS. 6.4*b* and 6.4*c*) does not provide a considerable improvement of the laminarization of the flow of the cooling/heating liquid. From the point of view of sufficient cooling/heating effect and at the same time from the point of view of manufacturing costs of the heat exchanger, the exchanger with 2 laminarizers 6 may be considered a preferred solution.

All the above described experiments confirmed that laminar flow of the cooling/heating liquid, achieved by means of one, preferably two laminarizers 6 placed in the housing 1 of the heat exchanger, ensures a more uniform and more efficient cooling/heating of the liquid, which is namely important for guaranteeing a uniform cooling/heating preventing the undesirable changes in the cooled/heated liquids—in particular for example the partial blood coagulation. It was demonstrated at the same time that more efficient cooling/heating of the liquid occurs in the exchanger with at least one, optionally more (preferably two) laminarizers 6 than in the exchanger without laminarizer(s) 6 according to example 1.

The invention claimed is:

1. A heat exchanger for cooling or heating blood in an external blood circulation comprising: an elongated, substantially cylindrical, housing (1), a plurality of capillaries (2), which are fastened inside the housing (1) by means of partitions (5) so that they are substantially parallel with the longitudinal axis of the housing (1) and mutually placed in defined distances from each other, wherein, the housing (1) comprises an inlet (4*a*) and an outlet (4*b*) of the cooling/heating liquid; a finishing element (9) at each end of the housing, the element containing an input (12*a*), or output (12*b*) of the cooled/heated blood; and at least one laminarizer (6) with a plurality of openings (10), with one opening (10) for each capillary (2), the diameter of the opening (10) is bigger than the outer diameter of the capillary (2), the at least one laminarizer (6) is placed so that capillaries (2) go through the centre of the openings (10) in the at least one laminarizer (6) in such a way that the cooling/heating liquid penetrates in the openings (10) completely around the capillaries (2) and substantially laminar flow of the cooling/heating liquid inside the housing (1) occurs;

the at least one laminarizer (6) and partition (5) are connected by distance pillars (15); and the partitions (5) are placed in the housing (1) so that a mounting space (11) of the partition (5) faces a space (3) for the cooling/heating liquid.

2. The heat exchanger according to claim 1 characterised in that it comprises two laminarizers (6).

3. The heat exchanger according to claim 1 characterised in that it is made of plastic.

4. The heat exchanger according to claim 1, characterised in that it is provided with a temperature sensor (16) at the input (12*a*) and/or output (12*b*) of the cooled/heated liquid.

* * * * *